US009045966B2

(12) United States Patent
Ali et al.

(10) Patent No.: US 9,045,966 B2
(45) Date of Patent: Jun. 2, 2015

(54) MULTI-CYCLE BALL ACTIVATED CIRCULATION TOOL WITH FLOW BLOCKING CAPABILITY

(71) Applicant: Baker Hughes Incorporated, Houston, TX (US)

(72) Inventors: Mohsen Ali, Houston, TX (US); Gregory Lee Hern, Porter, TX (US); Daniel Hart, Sugar Land, TX (US); Yang Xu, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 422 days.

(21) Appl. No.: 13/644,071

(22) Filed: Oct. 3, 2012

(65) Prior Publication Data

US 2013/0299184 A1 Nov. 14, 2013

Related U.S. Application Data

(63) Continuation-in-part of application No. 13/469,852, filed on May 11, 2012, which is a continuation-in-part of application No. 12/860,985, filed on Aug. 23, 2010, now Pat. No. 8,356,671, which is a continuation-in-part of application No. 12/826,020, filed on Jun. 29, 2010, now Pat. No. 8,739,864.

(51) Int. Cl.

| | |
|---|---|
| ***E21B 34/14*** | (2006.01) |
| ***E21B 21/10*** | (2006.01) |
| ***E21B 23/00*** | (2006.01) |
| *E21B 34/00* | (2006.01) |

(52) U.S. Cl.

CPC ..... *E21B 34/14* (2013.01); *E21B 2034/007* (2013.01); *E21B 21/103* (2013.01); *E21B 23/006* (2013.01)

(58) Field of Classification Search

CPC ..... E21B 34/14; E21B 2034/007

See application file for complete search history.

(56) References Cited

U.S. PATENT DOCUMENTS

| | | | | |
|---|---|---|---|---|
| 4,889,199 | A | 12/1989 | Lee | |
| 5,499,687 | A | 3/1996 | Lee | |
| 6,173,795 | B1 * | 1/2001 | McGarian et al. | 175/231 |
| 7,281,584 | B2 | 10/2007 | McGarian et al. | |
| 7,416,029 | B2 | 8/2008 | Telfer et al. | |
| 7,464,764 | B2 | 12/2008 | Xu | |
| 7,628,210 | B2 | 12/2009 | Avant et al. | |
| 7,637,323 | B2 | 12/2009 | Schasteen et al. | |
| 7,644,772 | B2 | 1/2010 | Avant et al. | |
| 8,616,285 | B2 * | 12/2013 | Tinker et al. | 166/334.4 |
| 2011/0278017 | A1 | 11/2011 | Themig et al. | |
| 2012/0043093 | A1 | 2/2012 | Cravatte | |

* cited by examiner

*Primary Examiner* — Giovanna C Wright

(74) *Attorney, Agent, or Firm* — Shawn Hunter

(57) ABSTRACT

A valve and method of use wherein the valve includes a housing having an axial flowbore defined along its length. A lateral fluid flow port is disposed through the housing. A piston sleeve is disposed within the flowbore and is selectively moveable to block flow through the lateral flow port. The valve can be moved between operating positions wherein flow through the lateral flow port is blocked or allowed and axial flow through the flowbore is blocked or permitted.

18 Claims, 12 Drawing Sheets

MULTI-CYCLE BALL ACTIVATED CIRCULATION TOOL WITH FLOW BLOCKING CAPABILITY

This application is a continuation-in-part of U.S. patent application Ser. No. 13/469,852 (US 2012/0227973) filed May 11, 2012, which is a continuation-in-part of U.S. patent application Ser. No. 12/860,985 (US 2011/0315390) filed Aug. 23, 2010, which is a continuation-in-part of U.S. patent application Ser. No. 12/826,020 (US 2011/0315389) filed Jun. 29, 2010.

BACKGROUND OF THE INVENTION

1. Field of the Invention

The invention relates generally to the design of circulation valves and sliding sleeve tools.

2. Description of the Related Art

Wellbore tools have been developed that are operated by a ball or plug that is dropped into the tool and landed on a seat within the tool. The ball or plug serves to increase pressure and/or to redirect fluid flow through the tool in order to operate the tool. Tools of this type include circulation valves which are used to selectively open and close lateral fluid flow ports in a tool sub to permit fluid flowing axially through the tool to be diverted into the surrounding flowbore.

The parent application to this one describes tools that operate by using balls or plugs of different sizes. The parent application to this application is U.S. patent application Ser. No. 13/469,852 filed May 11, 2012, which is incorporated herein by reference in its entirety.

SUMMARY OF THE INVENTION

The invention provides tools for use in subterranean hydrocarbon production. In a described embodiment, a circulation valve is provided that has an axial flowbore through which fluid is flowed. One or more lateral fluid flow ports are disposed through the housing of the valve. The circulation valve includes a circulation sub and a ball catcher sub. The ball catcher sub includes a ball catcher apparatus that removes actuation balls from the axial flowbore and deposits them into a retention chamber that radially surrounds the flowbore.

The circulation valve can be operated between an initial operating position wherein lateral fluid flow through the lateral fluid ports of the valve is blocked and axial flow through the valve is permitted to an operating position wherein flow through the lateral fluid flow ports of the valve is permitted and axial flow through the valve is also permitted. In addition, the circulation valve can also be moved to from the initial operating position to an alternate operating position wherein flow through the lateral fluid flow ports is permitted, but axial flow through the valve is blocked. In a described embodiment, the circulation valve is moved between operating positions by disposing suitably sized actuation balls (small, medium or large) into the flowbore and landing them onto the upper and/or lower ball seats.

The circulation valve includes an actuation mechanism for moving the circulation sub between operating positions. The actuation mechanism includes a radially expandable upper ball seat carried by a piston sleeve. The piston sleeve is moveably located within an expansion chamber that has a plurality of chamber portions of different diameters. The piston sleeve is also moveable between positions wherein it will either block or permit fluid flow through the at least one lateral flow port. Landing of an actuation ball onto the upper ball seat permits fluid pressure within the circulation sub to move the piston sleeve from one position to another.

The actuation mechanism also includes a lower ball seat within the ball catcher sub. The lower ball seat is adapted to capture and release suitably-sized actuation balls. A medium-sized or large actuation ball will be captured by the ball seat. However, a small actuation ball will pass through the lower ball seat.

The circulation valve is moved from the initial operating position to the lateral and axial flow-permitted operating position when a small ball is disposed into the flowbore of the valve. The circulation valve is moved from the initial operating position to the lateral flow permitted/axial flow blocked operating position when a medium-sized actuation ball is disposed into the flowbore of the valve. The circulation valve is moved back to its initial operating position when a large actuation ball is disposed into the flowbore of the valve.

The ball catcher sub includes a lower ball seat and a ball catcher apparatus. The ball catcher apparatus is designed to capture small, medium-sized and large actuation balls that are landed within the circulation valve and retain them in a chamber that is radially outside of the central flowbore of the valve. The lower ball seat is connected to a movable sleeve that is axially biased by a compression spring toward a closed position. Landing of an actuation ball onto the ball seat and build up of fluid pressure behind the actuation ball will open a lateral passage through which an actuation ball can pass into an annular retention chamber that radially surrounds the sleeve.

The design and features of the valve permit lost circulation material to be retained within the tool during lateral flow operations.

BRIEF DESCRIPTION OF THE DRAWINGS

For a thorough understanding of the present invention, reference is made to the following detailed description of the preferred embodiments, taken in conjunction with the accompanying drawings, wherein like reference numerals designate like or similar elements throughout the several figures of the drawings and wherein.

DETAILED DESCRIPTION OF THE PREFERRED EMBODIMENTS

Figure 1A:
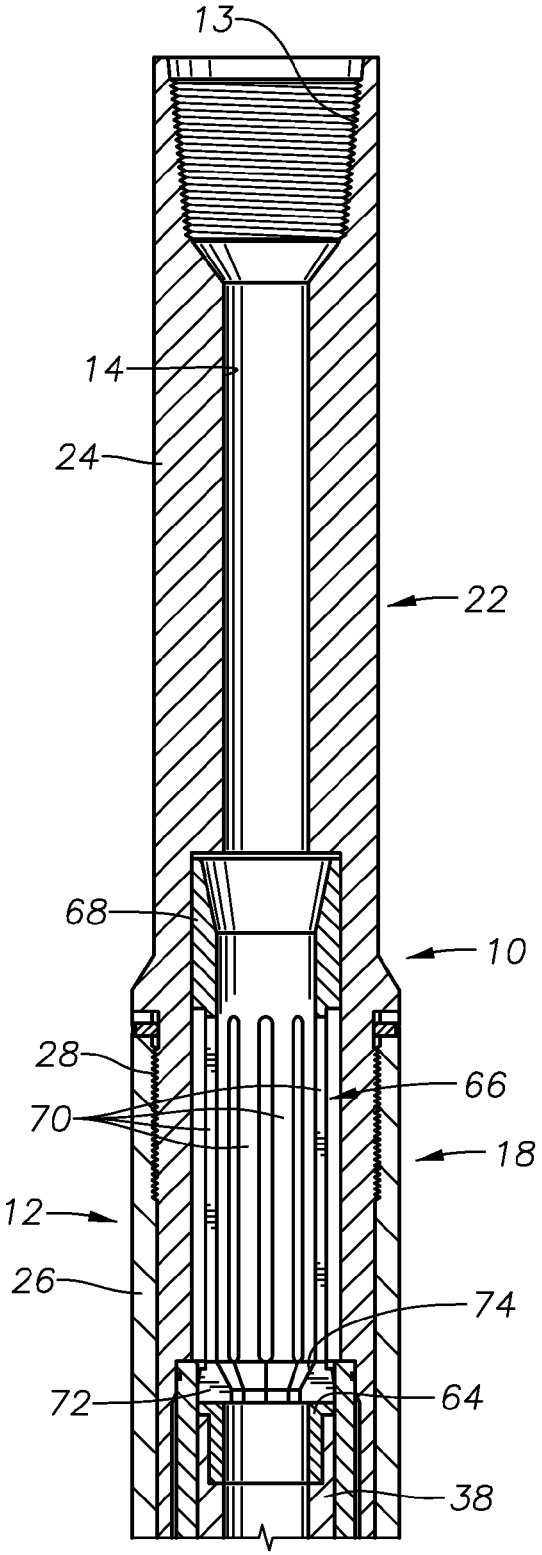
FIGS. 1A-1E are a side, cross-sectional view of an exemplary circulation valve constructed in accordance with the present invention in an initial run-in position wherein axial flow through the valve is permitted, but lateral fluid flow through the valve is blocked.
Figure 1B:
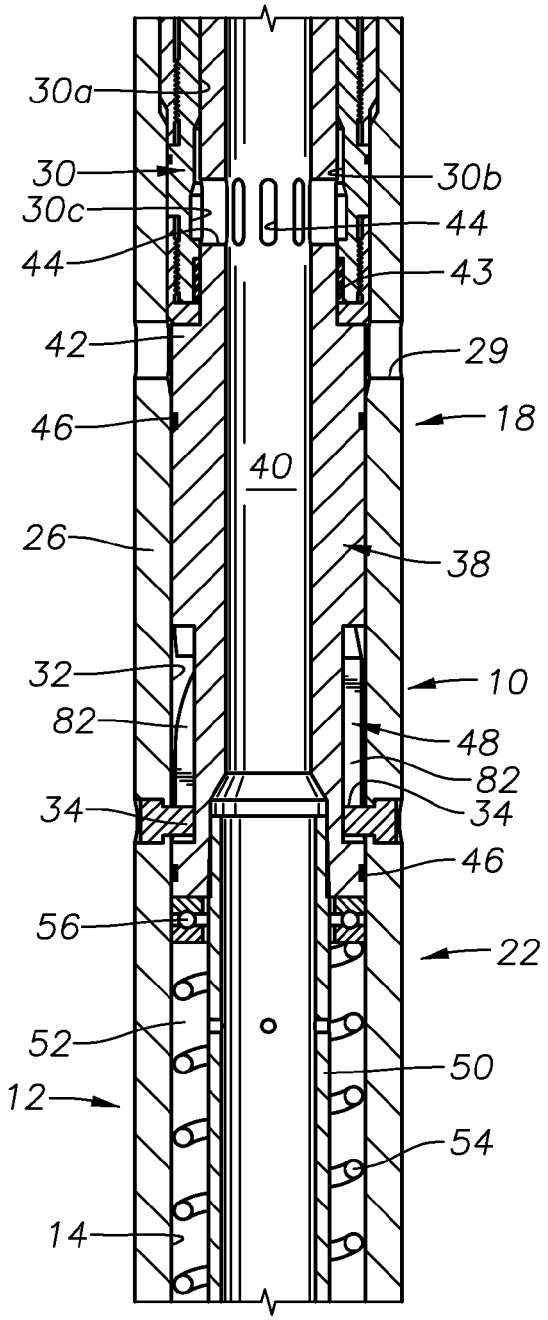

FIGS. 1A-1E depict an exemplary circulation valve 10 constructed in accordance with the present invention. The circulation valve 10 includes an outer housing, generally indicated at 12, which has a threaded box connection 13 at its upper axial end and a threaded pin connection 16 at its lower axial end. An axial flowbore 14 is defined along the length of the housing 12.

The exemplary circulation valve 10 generally includes an upper circulation sub 18 and an affixed ball catcher sub 20. Except as otherwise noted herein, the circulation sub 18 is constructed and operates in the same manner as the circulation valve tool that is described in detail in parent U.S. patent application Ser. No. 13/469,852. The circulation sub 18 includes a generally cylindrical circulation sub housing 22. In a currently preferred embodiment, the housing 22 is made up of an upper housing portion 24 and a lower housing portion 26 that are threaded together at connection 28. Lateral flow ports 29 are disposed through the housing 22 and permit fluid communication between the flowbore 14 and an area radially surrounding the housing 22.

Located within the housing 22, and preferably within the lower end of the upper housing portion 24, is a stepped expansion chamber, generally shown at 30. The expansion chamber 30 includes three chamber portions 30*a*, 30*b* and 30*c*, having interior diameters that sequentially increase. The large diameter chamber portion 30*c* has the largest diameter. The intermediate diameter chamber portion 30*b* has a diameter that is greater than that of the small chamber portion 30*a* but is smaller than that of the large diameter chamber portion 30*c*.

An indexing chamber 32 is defined within the housing 22 below the expansion chamber 30. One or more indexing lugs 34 are disposed through the housing 22 and protrude into the indexing chamber 32. Although two lugs 34 are shown, there may be more or fewer than two lugs 34.

A piston sleeve 38 is disposed within the flowbore 14. The piston sleeve 38 has a generally cylindrically body which defines a central axial flow path 40 along its length. A flange 42 projects radially outwardly from the body of the piston sleeve 38. Annular fluid seals 43 provide dynamic fluid sealing between the stepped expansion chamber 30 and the piston sleeve 38. Inner radial fluid ports 44 are disposed through the body of the piston sleeve 38 and permit fluid communication between the flow path 40 and an area radially surrounding the piston sleeve 38. Annular fluid seals 46 surround the piston sleeve 38 and seal against the surrounding housing 22.

The piston sleeve 38 includes an indexing portion 48. An extension sleeve 50 extends downwardly from the piston sleeve 38. An annular spring chamber 52 is defined radially between the housing 22 and the extension sleeve 50. A compression spring 54 is generally located within the spring chamber 62. The upper axial end of the compression spring 54 is in contact with a bearing 56 which is in contact with the lower end of the piston sleeve 38. The lower axial end of the compression spring 54 is in contact with an upper housing portion 58 of the ball catcher sub 20. A ferrule 64 is preferably secured to the upper end of the piston sleeve 38

An upper ball seat 66 is moveably disposed within the flowbore 14 and includes a base ring 68 with a plurality of collets 70 that extend axially therefrom. An arcuate segment 72 is formed at the distal end of each collet 70. The arcuate segments 72 collectively present an inwardly and upwardly directed seating surface 74, upon which an actuation ball can be seated.

Figure 2A:
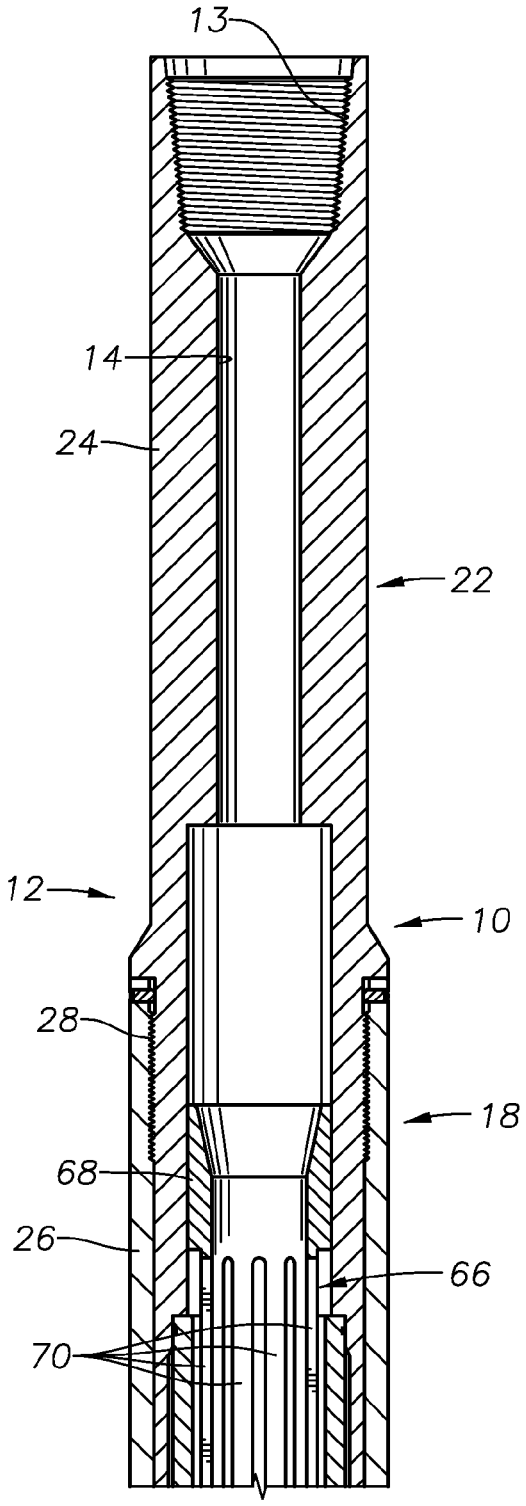
FIGS. 2A-2E are a side, cross-sectional view of the circulation valve shown in FIGS. 1A-1E, now in an intermediate position wherein a small or medium-sized ball is being used to shift the circulation valve 10 between first and second operating positions.
Figure 2B:
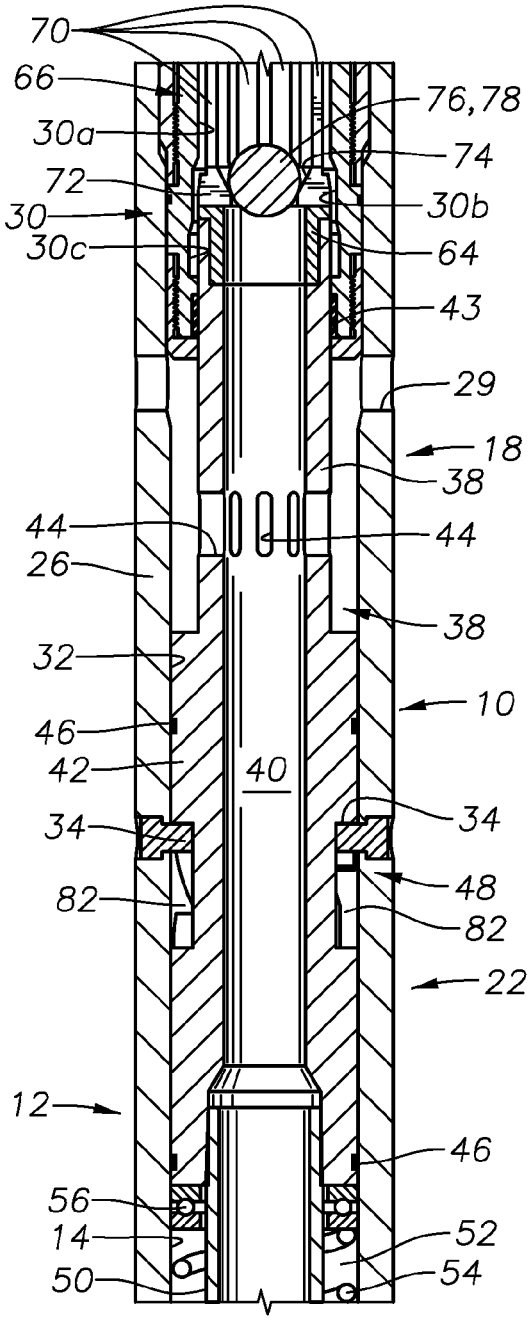
Figure 2C:
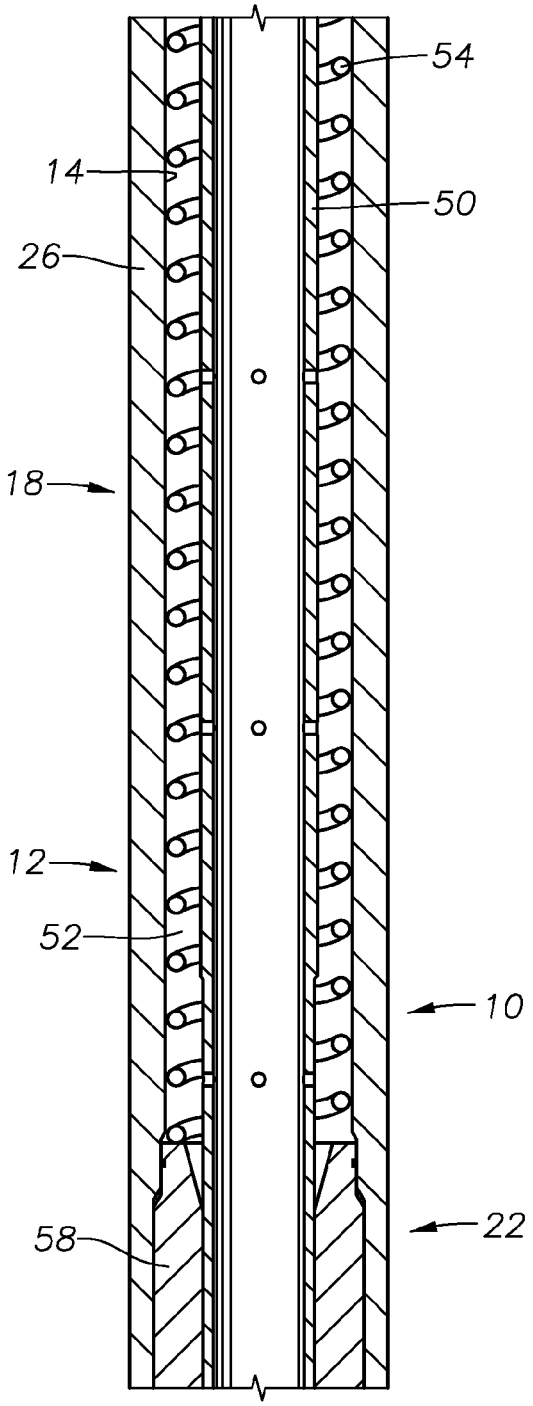

When the arcuate segments 72 are located in different sized chamber portions 30*a*, 30*b* and 30*c*, they can be expanded apart from one another or moved closer to one another in order to permit balls of various sizes to be captured and released by the ball seat 66. When the arcuate segments 72 are located within the most restricted small diameter portion 30*a* (see FIG. 1A), the seating surface 74 is in a fully retracted position. Therefore, a smaller actuation ball 76 as well as a medium-sized actuation ball 78 or a large actuation ball 80 can be seated and retained upon the seating surface 74. When the is arcuate segments 72 are located within the intermediate diameter portion 30*b* (FIG. 2B), the seating surface 74 is in a partially enlarged position since the segments 72 are spaced apart from each other within the confines of the chamber portion 30*b*. The smaller actuation ball 76 or medium-sized actuation ball 78 will pass through the central opening of the seating surface 74 in this configuration. However, a large actuation ball 80 will not be released. An exemplary ball size for the small ball 76 is 2.125 inches. An exemplary size for the medium-sized ball 78 is 2.250 inches. An exemplary size for the large ball 80 is 2.375 inches.

When the arcuate segments 72 are located within the largest diameter chamber portion 30*c*, the seat 52 will be in a further enlarged position, and each of the three sized balls 76, 78, 80 will pass through the central opening of the seating surface 74, releasing them. It is noted that, while spherical balls 76, 78, 80 are depicted in the drawings, the term "ball," as used herein, should be considered to encompass similar but non-spherical plugs and members of various shapes that perform the same functions described herein of the balls 76, 78 or 80.

As can be seen with reference to FIGS. 6-9, the indexing portion 48 of the piston sleeve 38 is located within and moveable within the indexing chamber 32. The indexing portion 48 has a lug pathway 82 inscribed therein. The lug pathway 82 is shaped and sized to receive the interior ends of the lugs 34 within. The lug pathway 82 generally includes a central circumferential path 84. A plurality of legs extends axially away from the central path 84. The pathway 82 is designed such that the number of each type of leg equals the number of lugs 34 that are used with the pathway 82. Long legs 86 and short legs 88 extend downwardly from the central path 84. In addition, long legs 90 and short legs 92 extend axially upwardly from the central path 84.

Figure 1C:
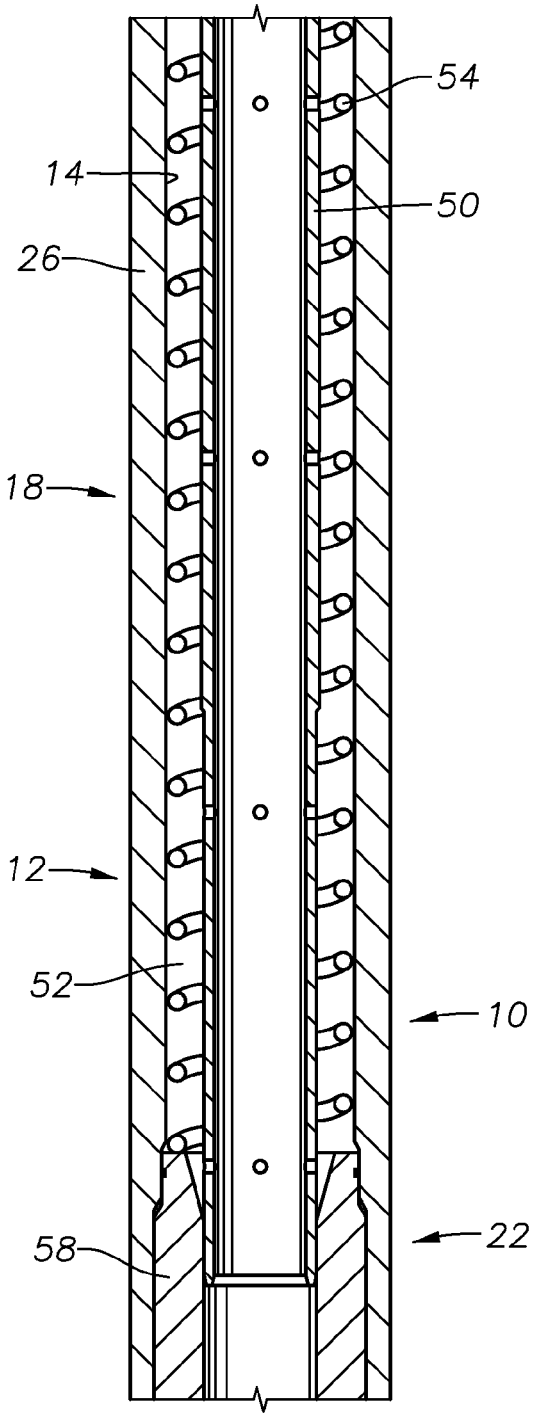
Figure 1D:
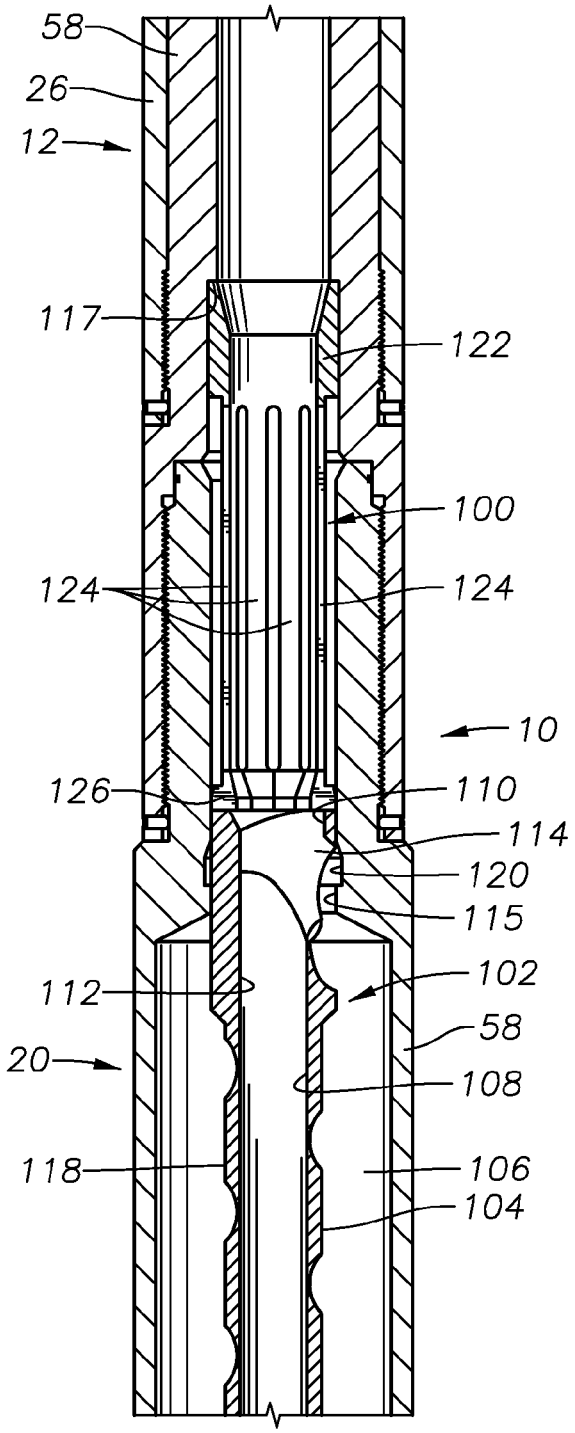
Figure 1E:
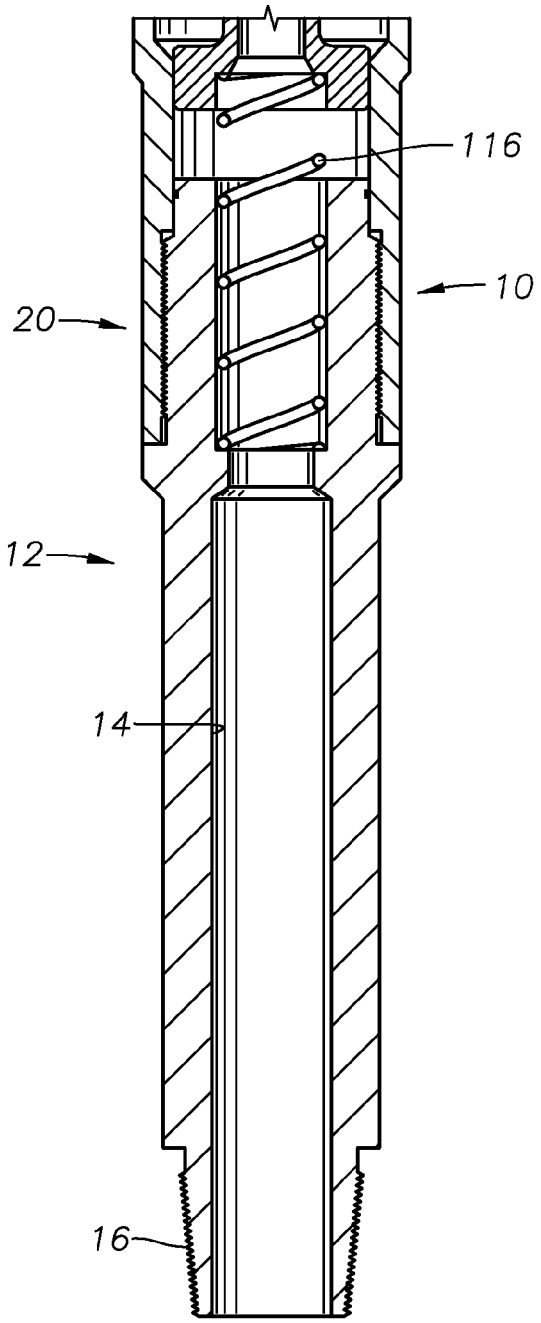

The ball catcher sub 20 includes a lower ball seat 100 that is moveably disposed within the housing portion 58 above a ball catcher apparatus 102. With the exception of differences hereinafter described, the ball catcher apparatus 102 is generally of the type described in U.S. Pat. No. 8,118,101 ("Ball Catcher with Retention Capability") by Nelson et al. U.S. Pat. No. 8,118,101 is owned by the assignee of the present application and is hereby incorporated by reference in its entirety. The ball catcher apparatus 102 includes a sleeve 104 that is moveably retained largely within a retention chamber 106. The sleeve 104 defines a central axial passage 108 along its length. The passage 108 has an inlet 110 of enlarged diameter. A reduced diameter section 112 is located directly below the inlet 110 within the passage 108. Lateral exit 114 is disposed through the sleeve 104. The lateral exit 114 is sized to permit actuation balls 76, 78 and 80 to pass through from the passage 108 to the retention chamber 106. A shoulder 115 is formed on the housing portion 58 and will help prevent balls from passing through the lateral exit 114 when not intended. A compression spring 116 urges the sleeve 104 axially upwardly and into contact with the lower ball seat 100. As can be seen in FIG. 1C, the lower ball seat 100 is initially retained against a shoulder 117. A spiral sleeve guide 118 is preferably formed around the outer surface of the sleeve 104 to help align multiple actuation balls within the retention chamber 106.

Figure 2D:
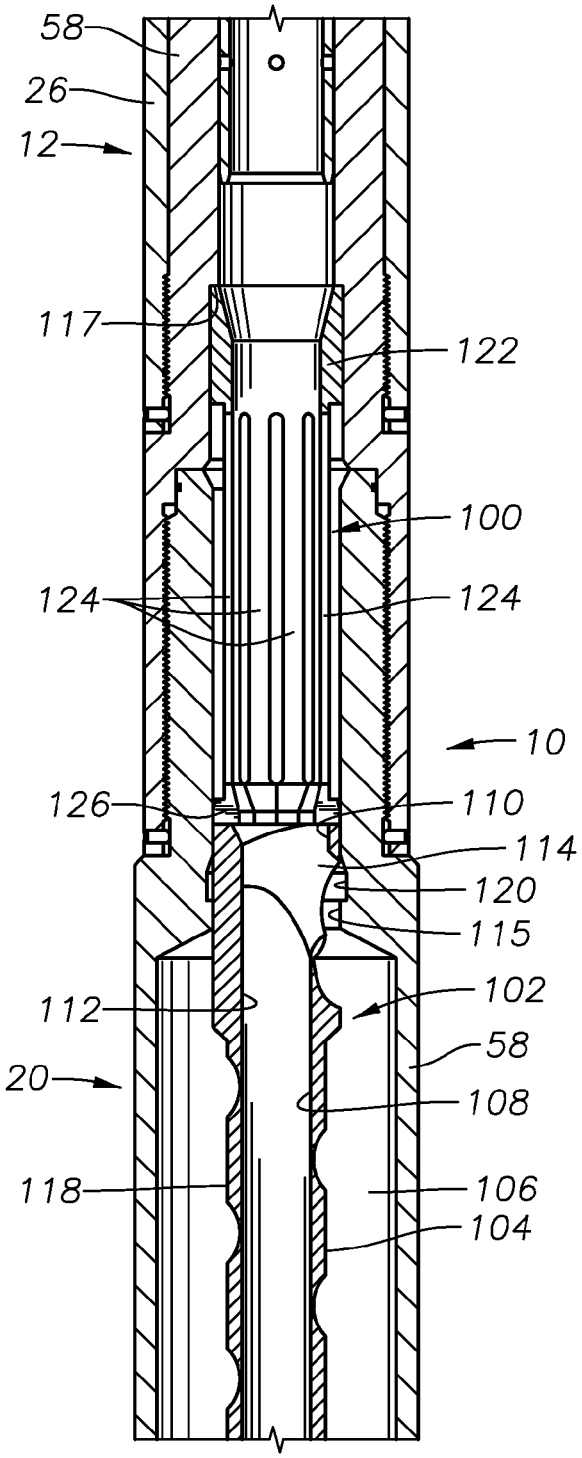
Figure 2E:
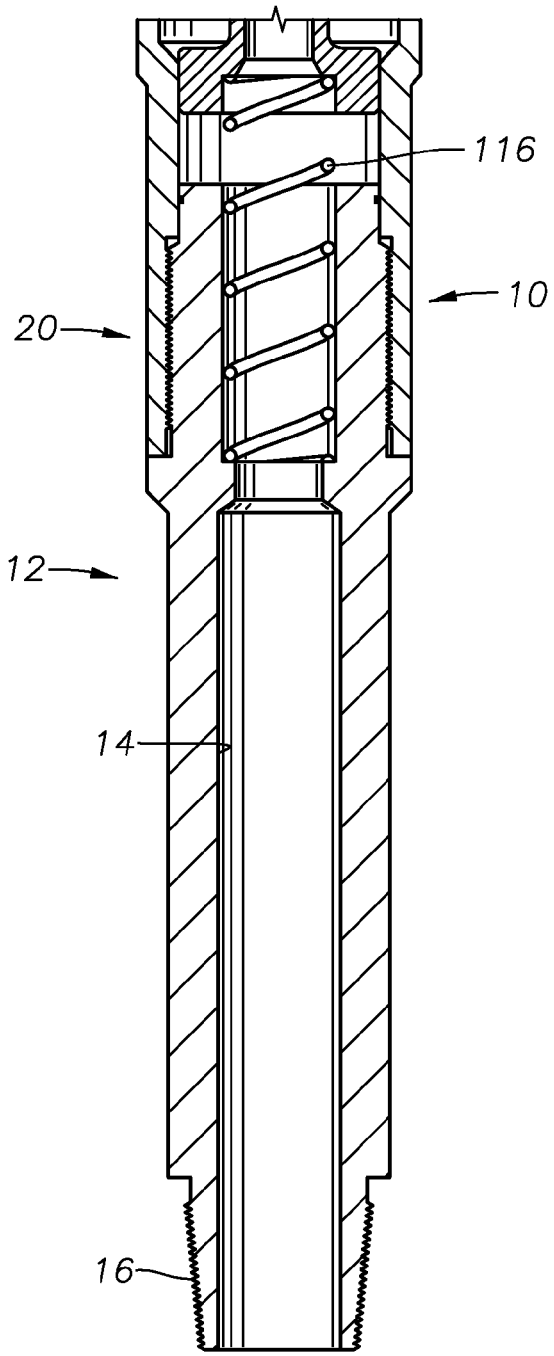
Figure 5:
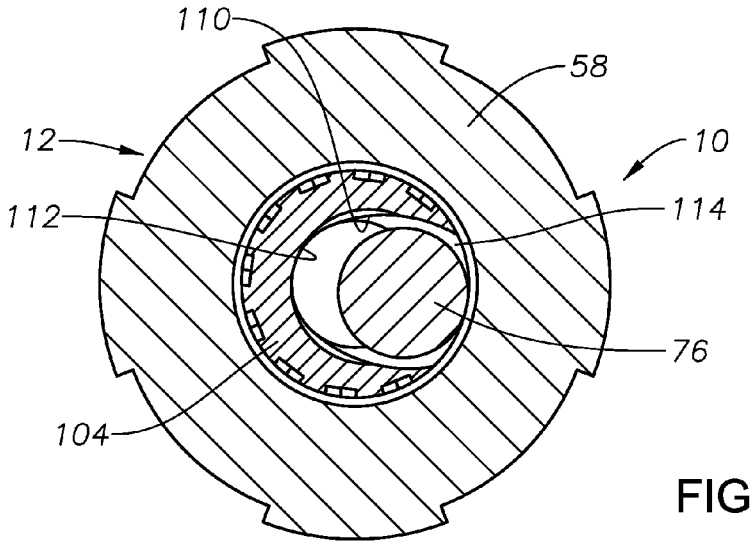
FIG. 5 is an axial cross-section taken along lines 5-5 in FIG. 4D.
Figure 6:
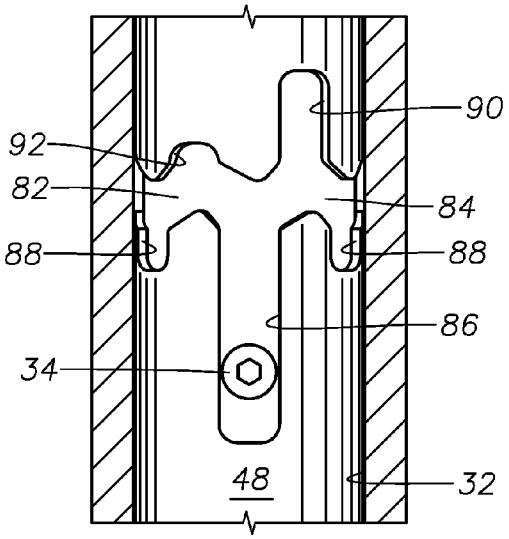
FIG. 6 is an enlarged side, partial cross-section of portions of the valve shown in FIGS. 1A-1E in a first operating position.

The lower ball seat 100 is operably associated with an expansion chamber 120. The lower ball seat 100 is constructed and operates in a similar manner as the upper ball seat 66 described previously. The lower ball seat 100 includes a base ring 122, collets 124 and arcuate segments 126. A small actuation ball 76 will pass through the lower ball seat 100 without being captured. Medium-sized and large actuation balls 78 and 80 will be captured by the lower ball seat 100. But, when the lower ball seat 100 is moved axially downwardly to a position wherein the arcuate segments 126 are located within the expansion chamber 120 (see FIG. 3D), the arcuate segments 126 can spread apart such that a medium-sized ball 78 or large ball 80 can pass through the ball seat 100. FIGS. 2D and 5 depict a small actuation ball 76, having passed through the ball seat 100, preparing to exit the lateral exit 114 into the retention chamber 106.

Figure 7:
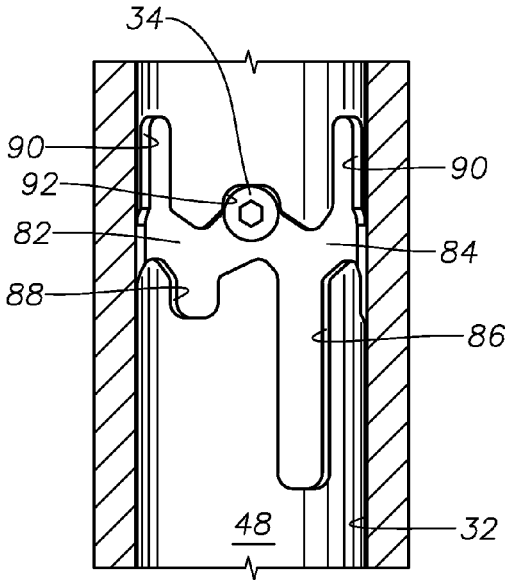
FIG. 7 is an enlarged side, partial cross-section of the valve portions shown in FIG. 6, now in a first intermediate position.
Figure 8:
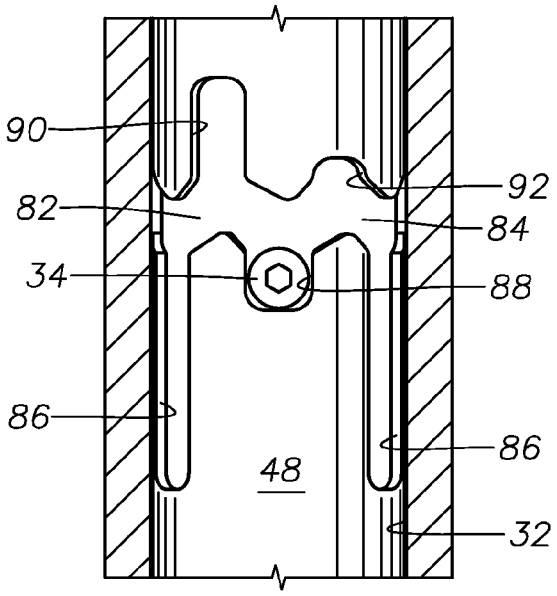
FIG. 8 is an enlarged side, partial cross-section of the valve portions shown in FIG. 6, now in a second operating position.
Figure 9:
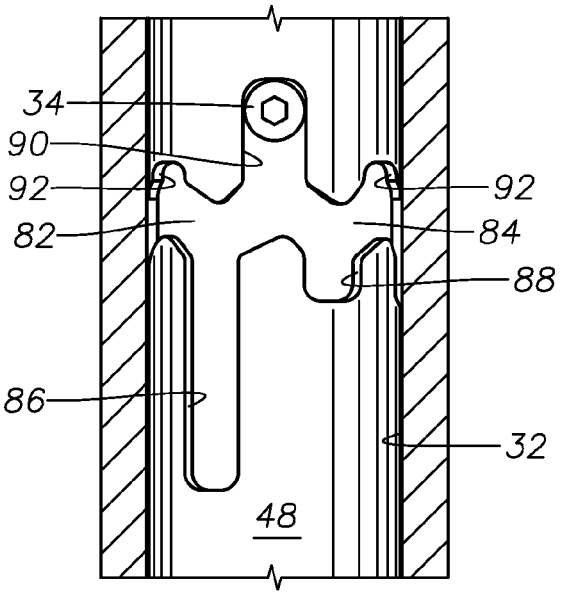
FIG. 9 is an enlarged side, partial cross-section of the valve portions shown in FIG. 6, now in a second intermediate position.

One can move the circulation valve 10 from the initial run-in position shown in FIG. 1 to an operating position wherein the lateral fluid flow ports 29 are open. When it is desired to open the lateral fluid ports 29 to permit fluid communication between the flowbore 14 and an area radially surrounding the housing 12, a small actuation ball 76 or a medium-sized actuation ball 78 is dropped into the flowbore 14 and landed onto the upper ball seat 66. Fluid pressure behind the actuation ball 76 or 78 urges the piston sleeve 38 axially downwardly with respect to the housing 12. The compression spring 54 is compressed. Each lug 34 moves along the lug pathway 82 of the indexing portion 48 from the long downwardly-extending leg 86 (see FIG. 6) to the short, upwardly-extending leg 92, to as shown in FIG. 7. As the piston sleeve 38 is moved axially, it is also rotated within the housing 12. When the lug 34 is located in the upwardly-extending leg 92, the arcuate segments 72 of the upper ball seat 66 are located within the intermediate diameter chamber portion 30*b*. As described in greater detail in the parent application to this one, the small ball 76 or medium-sized ball 78 will be released from the upper ball seat 66. Upon release of the small/medium ball 76/78, the compression spring 54 urges the piston sleeve 38 and upper ball seat 66 axially upwardly within the housing 12. Upward movement of the piston sleeve 38 will end when the lugs 34 shoulder out in short, downwardly-extending leg 88 (FIG. 8). In this position, the inner radial fluid ports 44 are aligned with the lateral fluid flow ports 29 of the housing 12, thereby allowing lateral fluid flow through the ports 29.

Figure 4A:
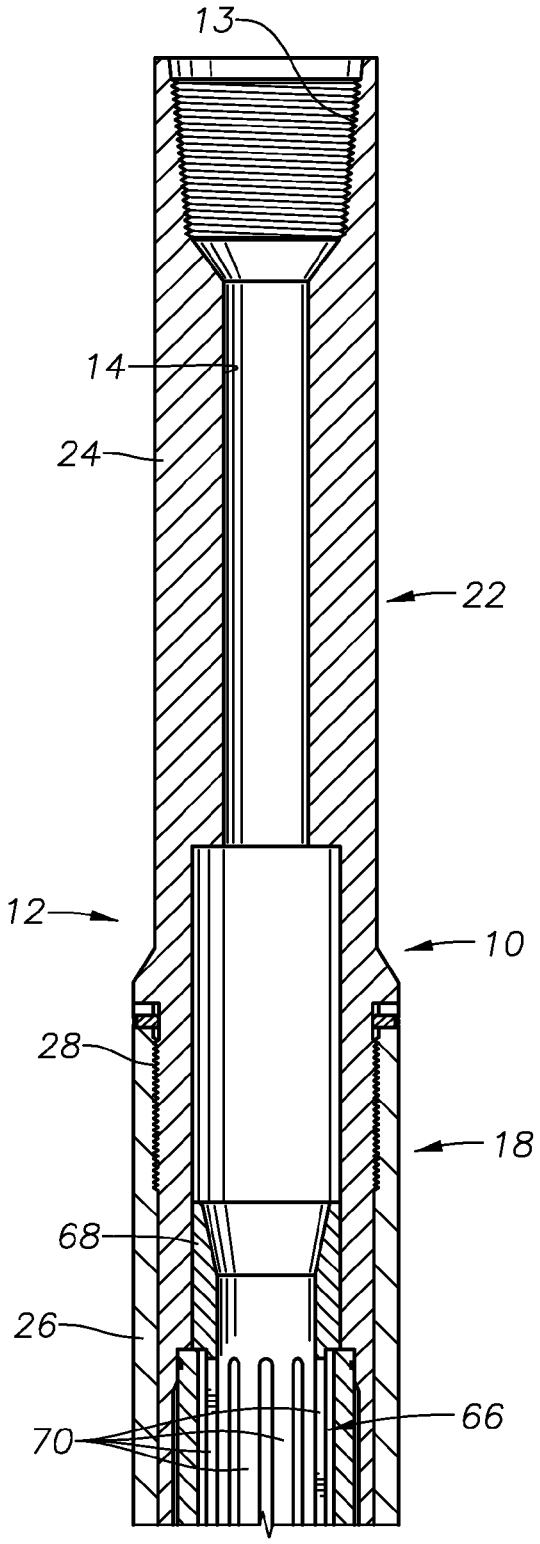
FIG. 4A-4E are a side, cross-sectional view of the circulation valve shown in FIGS. 1A-1E, 2A-2E and 3A-3E, now in an intermediate position wherein the lateral fluid flow ports are open to fluid flow and axial flow through the valve is also permitted.
Figure 4B:
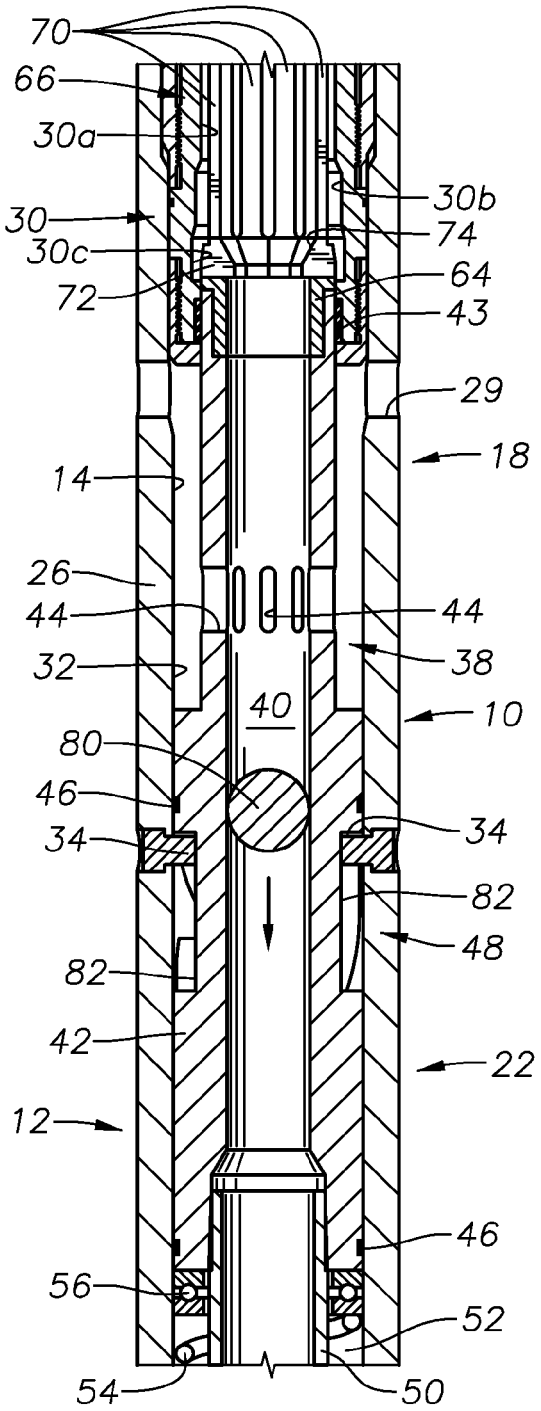
Figure 4C:
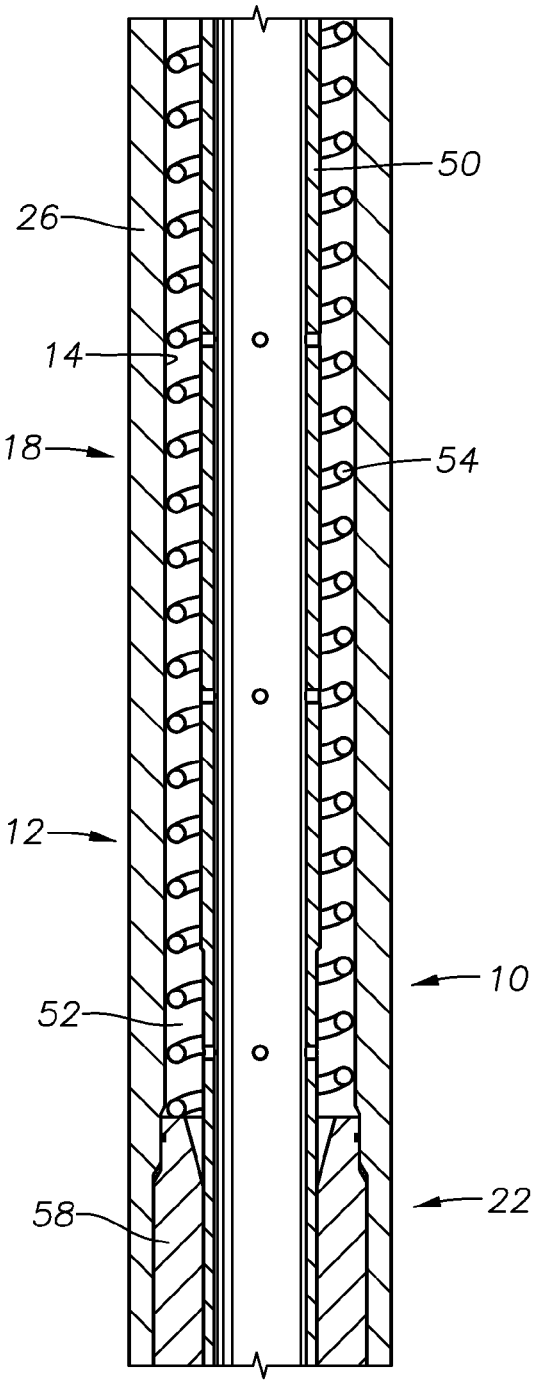
Figure 4D:
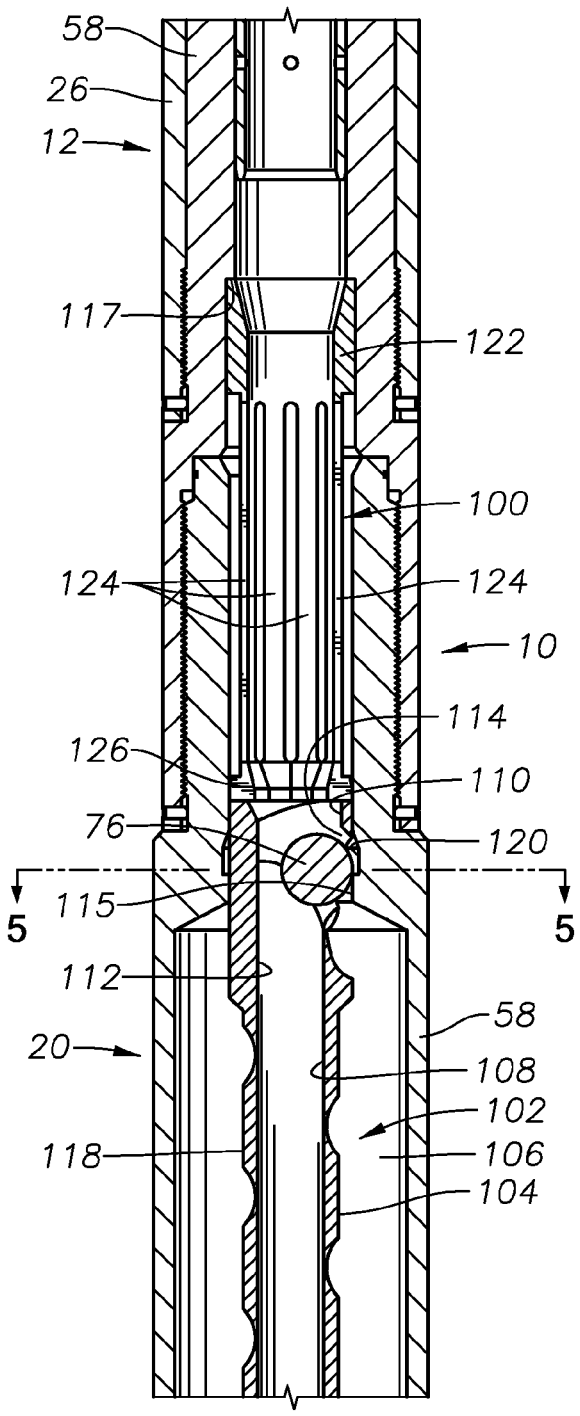
Figure 4E:
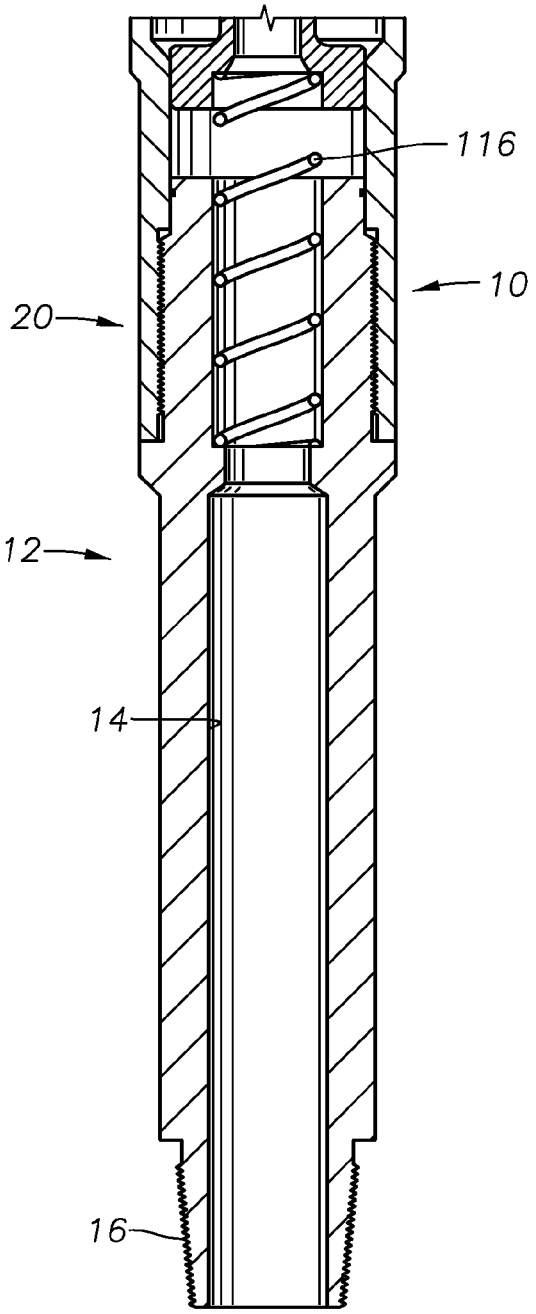

The released small or medium-sized actuation ball 76 or 78 will fall through the extension sleeve 50 and land upon the lower ball seat 100. If a small ball 76 is used, the small ball 76 will pass directly through the lower ball seat 100 without being captured by it. As depicted in FIGS. 4D and 5, the small ball 76 will be trapped against the shoulder 115 which precludes the small ball 76 from entering the retention chamber 106. In this position, axial fluid flow through the flowbore 14 of the valve 10 is permitted.

Figure 3A:
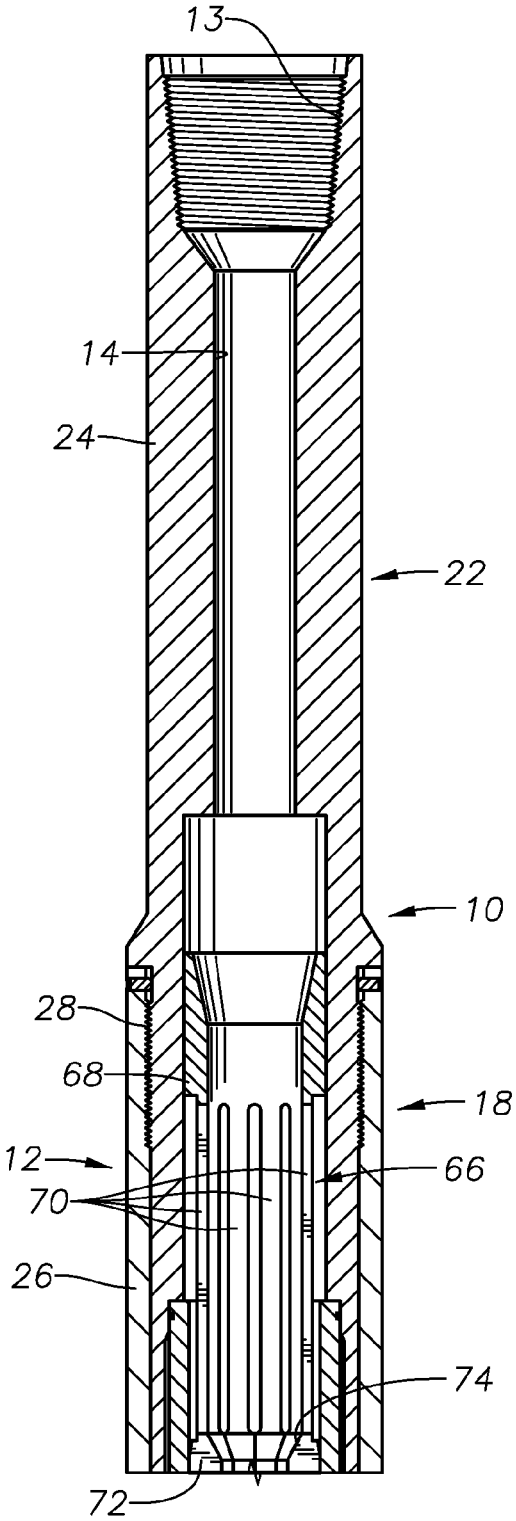
FIG. 3A-3E are a side, cross-sectional view of the circulation valve shown in FIGS. 1A-1E and 2A-2E, now in an operating position wherein the lateral fluid ports are open to fluid flow and axial flow through the valve is blocked.
Figure 3B:
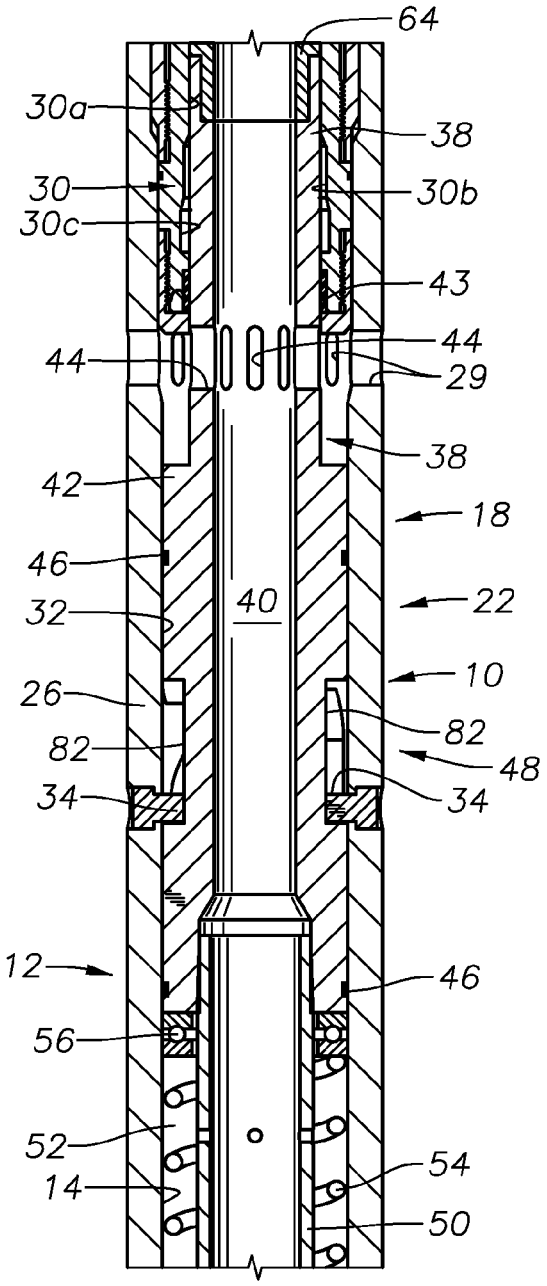
Figure 3C:
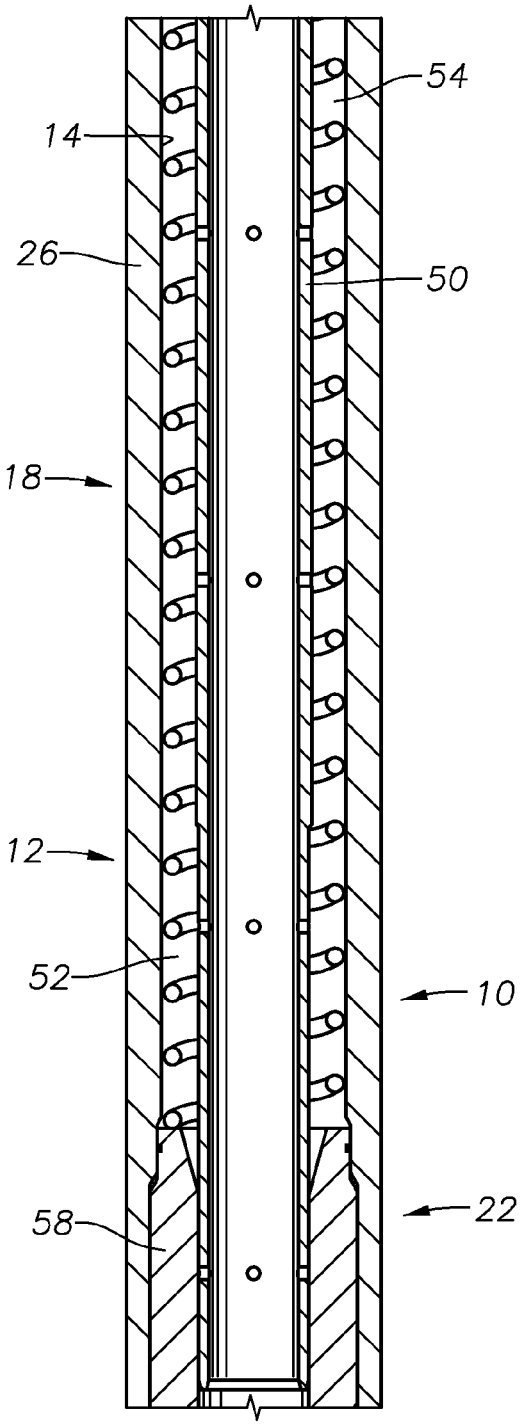
Figure 3D:
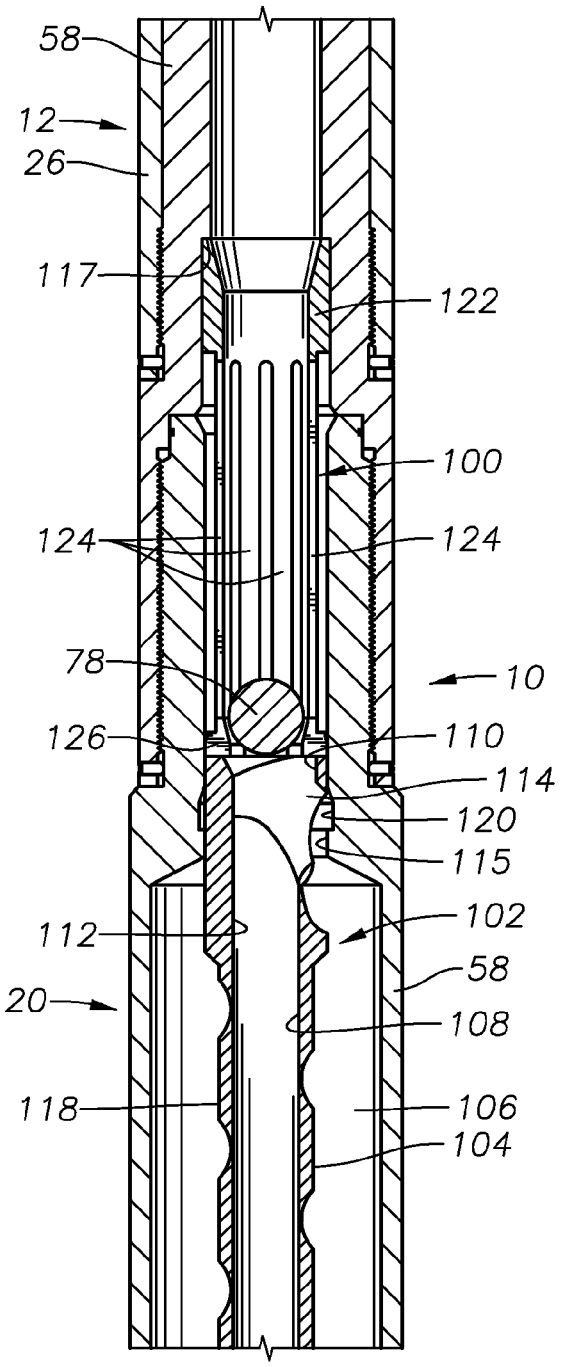
Figure 3E:
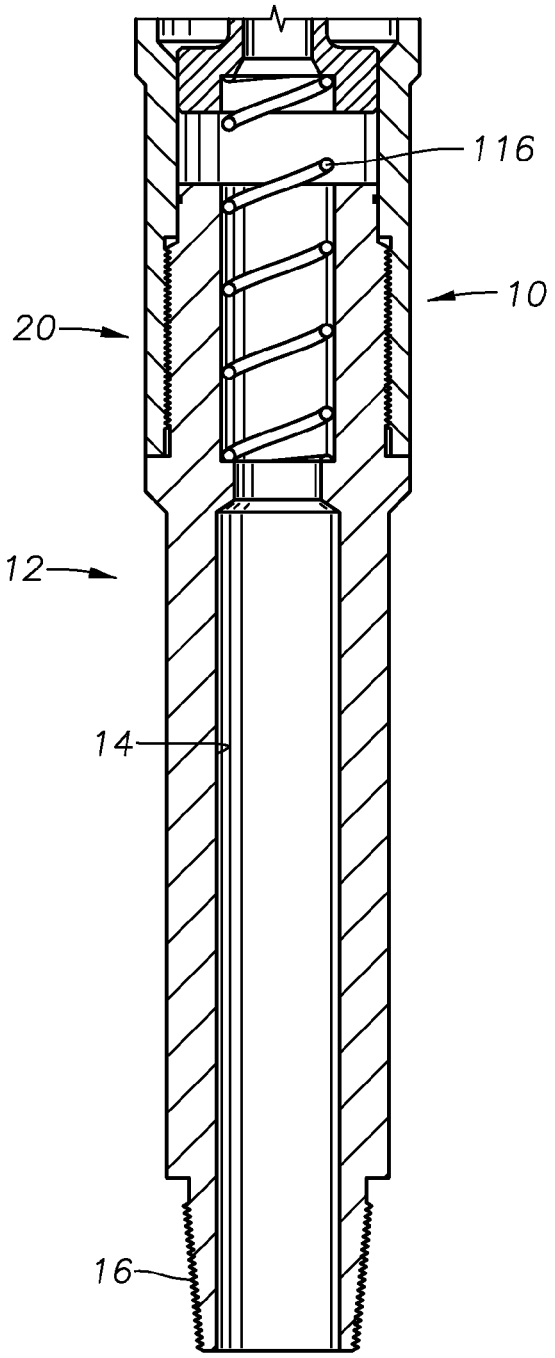

If a medium-sized ball 78 is used to open the lateral fluid flow ports 29, the medium-sized ball 78 will be thereafter captured by the lower ball seat 100, as shown in FIG. 3D. In this alternate operating position, the medium-sized ball 78 will block axial fluid flow through the flowbore 14. Because the lateral fluid flow ports 29 are also open to fluid flow, internal pressure within the flowbore 14 will be too low to create enough of a pressure differential across sleeve 104 to compress the spring 116.

The circulation valve 10 can be moved back to its original run-in position by dropping a large actuation ball 80 into the flowbore 14. The large ball 80 will land on the upper ball seat 66 and fluid pressure will urge the ball seat 66 and piston sleeve 38 axially downwardly within the housing 12. The lugs 34 are moved from the downwardly-extending leg 88 to the long, upwardly-extending leg 90 (see FIG. 9). When the lugs 34 are located in the leg 90, the arcuate segments 72 of the upper ball seat 66 are located within the large expansion chamber portion 30*c*, which allows the arcuate segments 72 to spread apart radially to permit the large ball 80 to be released from the upper ball seat 66. As the large ball 80 is released from the upper ball seat 66, the spring 54 will urge the piston sleeve 38 and upper ball seat 66 back to their original run-in position, as shown in FIGS. 1A-1E. Those of skill in the art will understand that, because the lug pathway 82 radially surrounds the indexing portion 48 in a continuous manner, the above-described steps may be repeated to cycle the tool 10 between operating positions wherein the lateral fluid flow ports 29 are either opened to fluid flow or closed against it.

It is noted that the large actuation ball 80 will, following release from the upper ball seat 66, land upon the lower ball seat 100 and will subsequently be released from the lower ball seat 100 as the arcuate segments 126 of the lower ball seat 100 are moved into the expansion chamber 120. Because the large actuation ball 80 has closed the lateral fluid ports 29, fluid pressure within the flowbore 14 will build up sufficiently behind the large actuation ball 80 and will urge sleeve 104 downwardly, compressing spring 116 and allowing the large actuation ball 80 and medium-sized actuation ball 78 to be released from the lower ball seat 100.

Upon release from the lower ball seat, the medium-sized ball 78 and the large ball 80 can enter the retention chamber 106 via the lateral exit 114. If a small-sized ball 76 was used to open the lateral circulation ports, it will be able to enter the retention chamber 106 via the lateral exit 114 when hydraulic pressure above large-sized ball 80 moves sleeve 104 downwardly. Thereafter, the flowbore 14 will be open to permit fluid flow through axially through the valve 10.

In operation, the circulation valve 10 is typically incorporated into a tool string and disposed into a wellbore or other surrounding tubular. Fluid is flowed downwardly through the valve 10 during operation. The circulation valve 10 can be operated between multiple operating positions by dropping suitably-sized balls into the flowbore 14 of the valve 10. FIGS. 1A-1E depict the circulation valve 10 in an initial run-in position wherein axial flow through the valve 10 is permitted, and the lateral flow ports 29 are closed against fluid flow. FIGS. 2A-2E depict the circulation valve 10 in an intermediate position wherein a small ball 76 or medium-sized ball 78 is being used to shift the circulation valve 10 between first and second operating positions. FIGS. 3A-3E depict the circulation valve 10 in an operating position wherein the lateral fluid ports 29 are open to fluid flow and axial flow through the valve 10 is blocked by a medium-sized ball 78. FIGS. 4A-4E show the circulation valve 10 in an intermediate position wherein the lateral fluid flow ports 29 are open to fluid flow and axial flow through the valve 10 is also permitted.

In alternative configurations, the ball seats 66 and 100 could be replaced with other ball seat designs, such as those described in the parent application to this.

Valves constructed in accordance with the present invention could, for example, be used as a circulation valve that provides the option of closing off axial fluid flow while continuing to permit flow through the lateral fluid flow ports 29. This feature would be useful to remove lost circulation material from the flowbore during operation by pumping it out through the lateral fluid flow ports 29. Blocking axial flow through the tool, while permitting flow through the lateral ports, is also desirable if the circulation valve is used as a Jet Sub. Maximizing flow through the lateral fluid flow ports 29 will improve the efficiency of dislodging debris that may be trapped in the wellbore or in a blowout preventer.

Those of skill in the art will recognize that numerous modifications and changes may be made to the exemplary designs and embodiments described herein and that the invention is limited only by the claims that follow and any equivalents thereof.

What is claimed is:

1. A valve comprising:

a housing defining an axial flowbore along its length;

a lateral fluid flow port disposed through the housing that provides fluid communication between the flowbore and an area radially surrounding the housing;

a piston sleeve disposed within the flowbore and moveable to selectively block fluid flow through the lateral flow port;

the valve being moveable between:

an initial operating position wherein fluid flow through the flowbore is permitted and flow through the lateral fluid flow port is blocked and each of:

a lateral flow operating position wherein axial fluid flow through the flowbore is permitted and flow through the lateral fluid flow port is permitted; and an alternate operating position wherein axial fluid flow through the flowbore is blocked and flow through the lateral fluid flow port is permitted.

2. The valve of claim 1 further comprising an upper ball seat that is operably associated with the piston sleeve, the upper ball seat adapted to capture and release a small actuation ball, a medium-sized actuation ball or a large actuation ball.

3. The valve of claim 2 wherein the valve is moved from the initial operating position to the lateral flow operating position by landing a small or medium-sized actuation ball onto the upper ball seat to shift the piston sleeve from a position wherein it blocks fluid flow through the lateral fluid flow port to a position wherein it does not block fluid flow through the lateral fluid flow port.

4. The valve of claim 1 further comprising a lower ball seat located within the flowbore below the piston sleeve, the lower ball seat adapted to:

capture and release a large actuation ball or a medium-sized actuation ball; and allow a small actuation ball to pass through.

5. The valve of claim 4 wherein the lower ball seat is located within a ball catcher sub, the ball catcher sub having a retention chamber to receive an actuation ball and maintain said actuation ball outside of the axial flowbore.

6. The valve of claim 1 wherein the valve is moved from the lateral flow or alternate operating position back to the initial operating position by landing a large actuation ball onto the upper ball seat to shift the piston sleeve from the position wherein it does not block fluid flow through the lateral fluid flow port to a position wherein it does block fluid flow through the lateral fluid flow port.

7. The valve of claim 1 wherein the valve is moved to the alternate operating position by landing a medium-sized actuation ball onto the lower ball seat to block axial fluid flow through the valve.

8. A valve comprising:

a housing defining an axial flowbore along its length;

a lateral fluid flow port disposed through the housing that provides fluid communication between the flowbore and an area radially surrounding the housing;

a piston sleeve disposed within the flowbore and moveable to selectively block fluid flow through the lateral flow port;

the valve being moveable between:

a) an initial operating position wherein fluid flow through the flowbore is permitted and flow through the lateral fluid flow port is blocked and each of:

b) a lateral flow operating position wherein axial fluid flow through the flowbore is permitted and flow through the lateral fluid flow port is permitted;

c) an alternate operating position wherein axial fluid flow through the flowbore is blocked and flow through the lateral fluid flow port is permitted; and an upper ball seat adapted to capture and release a small actuation ball, a medium-sized actuation ball or a large actuation ball.

9. The valve of claim 8 further comprising:

a lower ball seat adapted to capture and release a large actuation ball or a medium-sized actuation ball and allow a small actuation ball to pass through without being captured.

10. The valve of claim 9 wherein the valve is moved from the initial operating position to the alternate operating position by:

landing a medium-sized actuation ball onto the upper ball seat to shift the piston sleeve from the position wherein it does not block fluid flow through the lateral fluid flow port to a position wherein it does block fluid flow through the lateral fluid flow port; and thereafter landing the medium-sized actuation ball onto the lower ball seat to block axial fluid flow through the axial flowbore.

11. The valve of claim 8 wherein the valve is moved from the initial operating position to the lateral flow operating position by landing a small actuation ball onto the upper ball seat to shift the piston sleeve from a position wherein it blocks fluid flow through the lateral fluid flow port to a position wherein it does not block fluid flow through the lateral fluid flow port.

12. The valve of claim 9 wherein the lower ball seat is located within a ball catcher sub, the ball catcher sub having a retention chamber to receive an actuation ball and maintain said actuation ball outside of the axial flowbore.

13. The valve of claim 8 wherein the valve is moved from the lateral flow or alternate operating position back to the initial operating position by landing a large actuation ball onto the upper ball seat to shift the piston sleeve from the position wherein it does not block fluid flow through the lateral fluid flow port to a position wherein it does block fluid flow through the lateral fluid flow port.

14. A method of operating a valve having a housing defining an axial flowbore along its length, a lateral fluid flow port disposed through the housing, and a piston sleeve disposed within the flowbore and moveable to selectively block fluid flow through the lateral flow port, the method having the steps of:

flowing fluid through the flowbore;

moving the valve from an initial operating position wherein fluid flow through the flowbore is permitted and flow through the lateral fluid flow port is blocked to each of a) a lateral flow operating position wherein axial fluid flow through the flowbore is permitted and flow through the lateral fluid flow port is permitted, and b) an alternate operating position wherein axial fluid flow through the flowbore is blocked and flow through the lateral fluid flow port is permitted; and moving the valve back to the initial operating position.

15. The method of claim 14 wherein the step of moving the valve from the initial operating position to the lateral flow operating position comprises disposing a first actuation ball into the flowbore.

16. The method of claim 15 wherein the step of moving the valve from the initial operating position to the alternate operating position comprises disposing an actuation ball into the flowbore having a diameter that is larger than that of the first actuation ball.

17. The method of claim 15 wherein the step of moving the valve back to the initial operating position further comprises disposing a large actuation ball into the flowbore, the large actuation ball having a diameter that is larger than that of the first actuation ball.

18. The method of claim 17 wherein the step of moving the valve back to the initial operating position further comprises moving at least one actuating ball from the flowbore into a retention chamber that lies radially outside of the flowbore.

* * * * *